United States Patent [19]

Shames et al.

[11] 4,254,914

[45] Mar. 10, 1981

[54] PULSATING SHOWER HEAD

[76] Inventors: Sidney J. Shames, 57 Holly Pl., Briarcliff Manor, N.Y. 10510; Harold Shames, 5 Agnes Cir., Ardsley, N.Y. 10502

[21] Appl. No.: 75,811

[22] Filed: Sep. 14, 1979

[51] Int. Cl.[3] ..... B05B 1/34

[52] U.S. Cl. ..... 239/383; 239/447

[58] Field of Search ..... 239/444–449, 239/460, 381–383, 101, 102; 401/28; 251/231, 235; 137/625.31

[56] References Cited

U.S. PATENT DOCUMENTS

| | | | |
|---|---|---|---|
| 3,568,716 | 3/1971 | Heitzman | 239/383 X |
| 3,801,019 | 4/1974 | Trenary et al. | 239/444 X |
| 3,929,287 | 12/1975 | Givler et al. | 239/447 X |
| 4,131,233 | 12/1978 | Koenig | 239/447 X |

*Primary Examiner*—Bruce H. Stoner, Jr.
*Assistant Examiner*—Gene A. Church
*Attorney, Agent, or Firm*—Norman Lettvin

[57] ABSTRACT

A shower head for selectively discharging therefrom, alternatively and respectively from one of two sets of apertures, a regular shower spray or a pulsating shower spray is inexpensively provided by the use of molded parts that include a shell and a downstream housing which telescopes into the shell, and with diverter means provided, by a molded diverter body and a pivotable diverter shaft therein, for selectively directing the water that enters the diverter body to one or the other of the two sets of apertures associated with the downstream housing. The pulsating shower spray is achieved by means that includes a propeller, and a molded nozzle plate that directs incoming water in streams against the propeller, whose movement past the set of discharge apertures operates to provide a pulsating discharge therefrom. The parts are so constructed that certain seal means provided within the shower head provide sealing functions with multiple parts, and the resilience of one of the seal means also provides an axial accommodation, during assembly, for different axial spacings that could occur between the downstream housing and the shell.

7 Claims, 5 Drawing Figures

FIG. 3
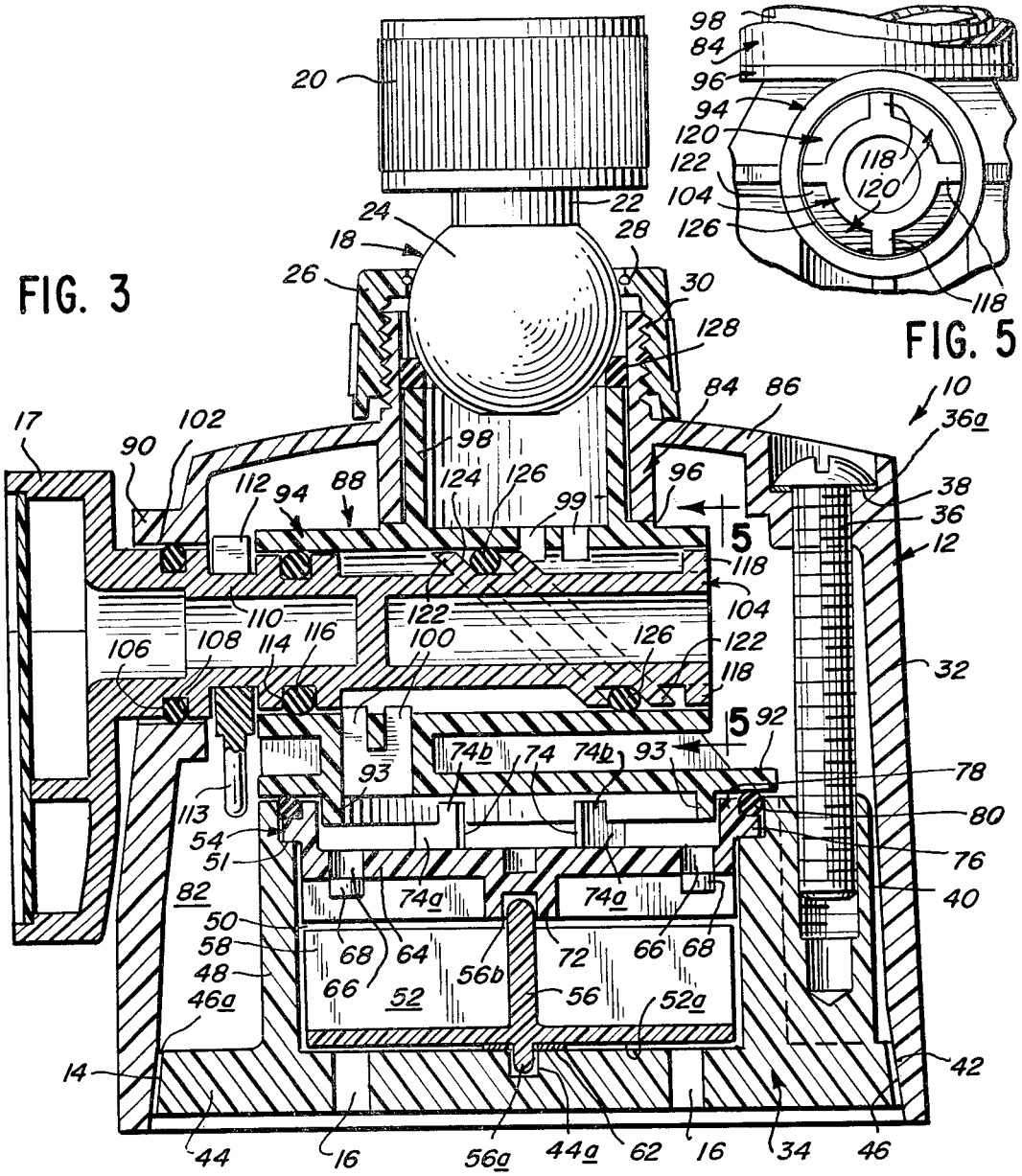
FIG. 5
FIG. 4
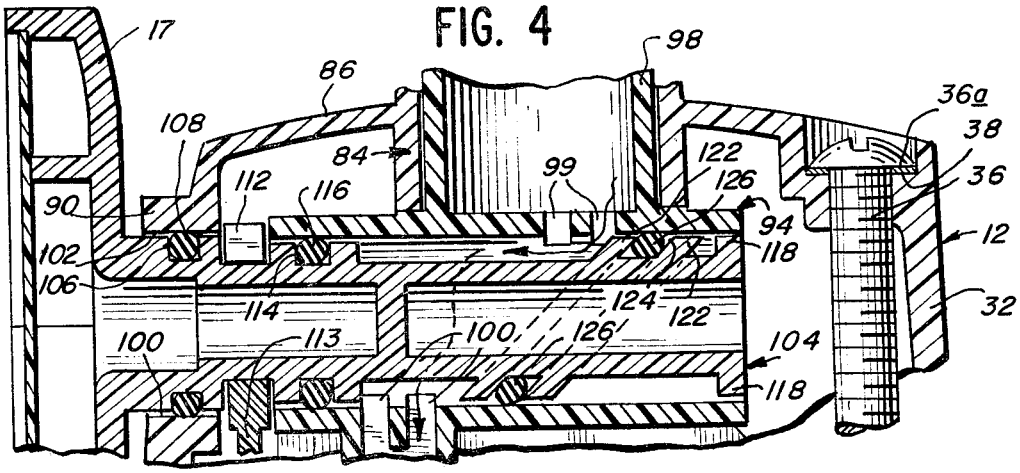

PULSATING SHOWER HEAD

FIELD OF THE INVENTION

This invention relates to a shower head from which a regular spray or pulsating spray may be selectively discharged. More particularly this invention relates to a shower head made of molded plastic parts and with simplified means provided therein for directing water flow to one of two alternate sets of spray apertures.

BACKGROUND OF THE INVENTION

Shower heads typically discharge therefrom a spray of water in a conical pattern. It has also been known to provide the discharge of a pulsating spray stream from a shower head, using a propeller with a shutter for alternatively covering and uncovering a spray outlet to cyclically interrupt flow of water to the discharge apertures. In recent years shower heads have been provided with alternative multiple spray features, namely a usual shower spray or a pulsating shower spray. Such concepts are disclosed, for example, in U.S. Pat. No. 3,801,019 and No. 3,958,754. In such prior disclosures a shutter means is provided that is selectively rotatable about the longitudinal axis of the shower head to direct the inflow water either to one or the other of the two sets of discharge apertures. Such spray-or-pulsating shower heads utilize complex diverter constructions that are costly.

Thus, one object of this invention is to provide a shower head that is constructed to selectively discharge therefrom a regular spray or pulsating spray, and which is characterized by simplicity and inexpensiveness of construction.

Another object of this invention is to provide an inexpensive shower head for discharging selectively therefrom a regular spray or a pulsating spray, and with control of selectivity between the sprays being achieved by use of a simple, pivotable shaft that pivots about an axis that is transverse to the longitudinal axis of the shower head.

And a further object of this invention is to provide an inexpensive shower head for selectively discharging therefrom a regular spray or a pulsating spray, and wherein the principal parts of the shower head are molded, with use of a seal between parts that not only provides sealing with multiple parts, but whose resiliency also provides an axial accommodation, during assembly, for parts of varying dimensions.

Further objects and advantages will become apparent to one skilled in the art as the following description of the invention proceeds.

BRIEF SUMMARY OF THE INVENTION

A shower head for discharging selectively either a regular spray or a pulsating spray is provided in an inexpensive construction. A control for selecting which of the sprays will be discharged is provided by use of a diverter body that has a radial control sleeve defined therein into which inflow water enters, and a diverter shaft pivotly mounted in said control sleeve for directing the inflow water into one of two alternate flow paths that respectively communicate with the respective apertures for the two different sprays. One alternate flow path proceeds outwardly from the control sleeve and outwardly of the diverter body, but the other flow path is through the diverter body.

The alternate paths are selected through use of a diagonally disposed seal carried on the pivotable diverter shaft. The diverter shaft is assembled through the side wall of the shower head's shell, entering the radial control sleeve of the diverter body, and being provided with a snap-on retainer assembled onto said shaft to prevent disassembly. The pulsating spray is secured through use of a propeller driven by angled discharge of water from a spray plate. A single compressible O-ring seal is provided, sealingly engaged by the diverter body, the spray plate, and a sleeve mounting for the spray plate, to obtain multiple seals.

BRIEF DESCRIPTION OF THE DRAWINGS

FIG. 3 is an enlarged, cross-sectional view of the assembled shower head of FIGS. 1 and 2, the cross-section being taken in a vertical plane substantially through the longitudinal axis of the shower head, showing the upstream ball connector in elevation and the control handle in its position for directing water flow to the set of regular spray apertures of the shower head;

FIG. 4 is a fragmentary view of a portion of the shower head illustrated in FIG. 3, but showing the control handle in its alternate position for directing water flow to the set of flow apertures from which a pulsating spray is discharged; and FIG. 5 is an end elevational view taken substantially on line 5—5 of FIG. 3, showing the detail of the flow passageway defined between the end of the diverter shaft and the control sleeve of the diverter body.

DESCRIPTION OF THE PREFERRED FORM

Figures 1, 2:
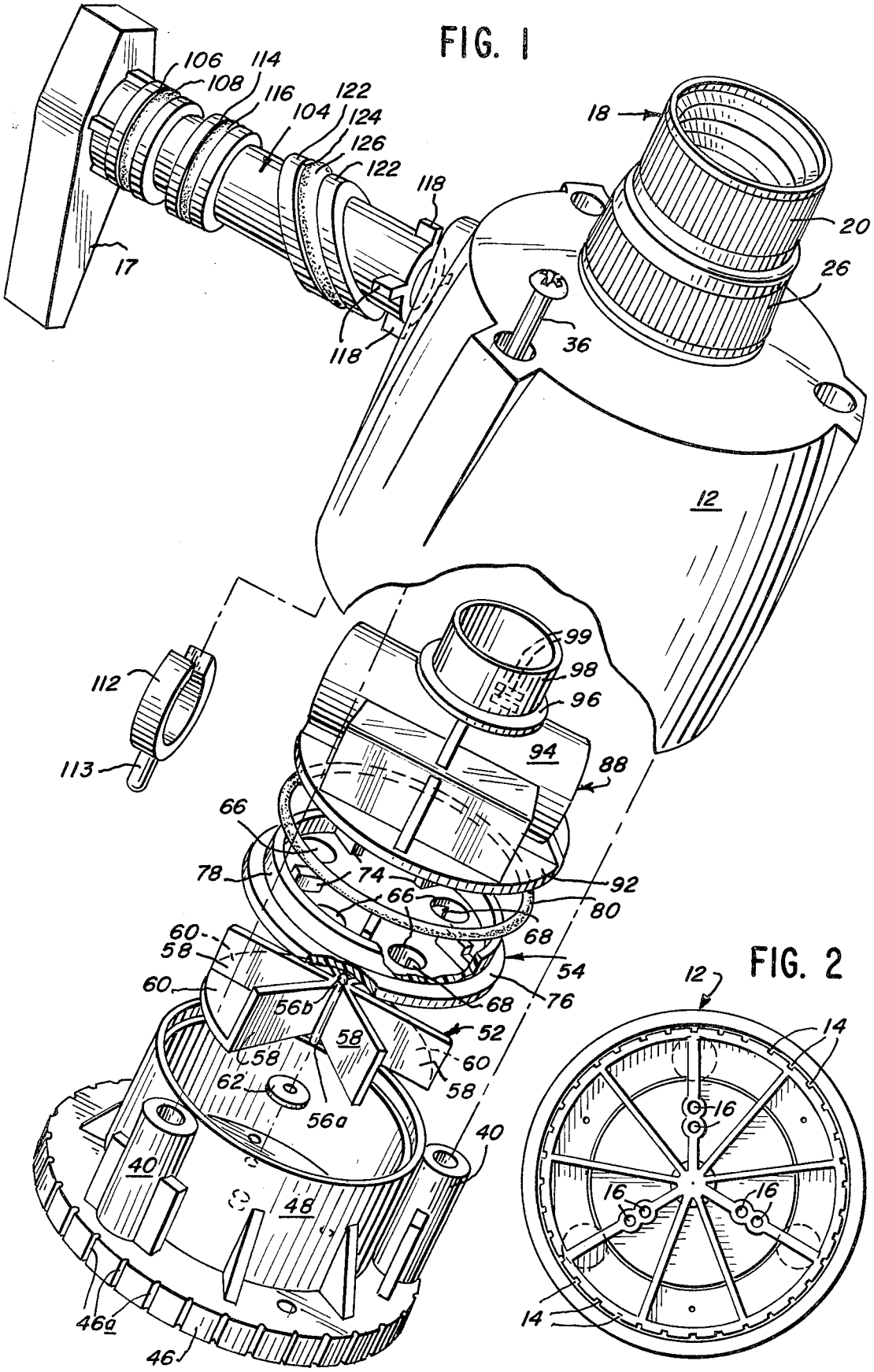
FIG. 1 is an exploded, partially fragmentary, perspective view of a shower head constructed in accordance with the invention herein.
FIG. 2 is a slightly reduced, bottom plan view of the discharge face of the shower head shown in FIG. 1.

Referring now to the Figures, the assembled shower head 10 includes an axially elongated body shell 12 having its upstream end provided with female-threaded coupling means for connection to a source of liquid, not shown, which is typically a male-threaded pipe end to which the shower head is to connect. The downstream end of the shower head provides a first set of relatively small apertures 14, adjacent the outer periphery of the shower head, from which a normal shower spray is to be discharged, and a set of centrally located, relatively large flow apertures 16 from which a pulsating shower spray is to be discharged. The shower head 10 provides a control handle 17, which is pivotable about an axis transverse to the longitudinal axis of body 12, between a first position (FIG. 3) in which regular spray discharges from apertures 14, and a second position (FIG. 4) in which a pulsating spray discharges from apertures 16.

As seen in FIGS. 1 and 3, the upstream female-threaded coupling means includes a ball connector 18 that provides, integrally as one part, an upstream, female-threaded, coupling portion 20 adapted for connection to a male-threaded pipe end, a bored spacer neck 22, and a downstream, axially bored, pivot ball 24. A molded annular coupling nut 26, of greater inner diameter than pivot ball 24, is assembled onto ball 24, and receives into a groove, provided on its inner-most periphery, a snap-ring retainer 28 constructed for engagement with pivot ball 24. The coupling nut 26 is female-threaded at 30 and adapted for connection to a threaded sleeve portion of the body 12 of the shower head. The outer peripheries of coupling portion 20 and coupling nut 26 are molded with serrations, as shown, to provide for ease in finger manipulation of those parts to effect screw connection or disconnection.

Referring now to the body of the shower head, the shower head includes a molded, inverted cup-shaped, axially elongated upstream body shell 12 having a continuous, peripheral, side wall 32 and a molded downstream housing 34 that substantially closes off the downstream end of shell 12, to define therebetween a space in which is located the parts of the shower head shown in detail in FIGS. 1 and 3. The shell 12 and downstream housing 34 are assembled and held together by three, symmetrically-disposed, elongated bolts 36, whose respective heads seat against a fiber washer 36*a* supported on recessed shoulders 38 provided in shell 32, and whose threaded stems screw into tapped bosses 40 provided integrally on downstream housing 34.

The shell 12 has an open downstream end bounded by a continuous side wall 32 whose inner periphery at 42, adjacent the downstream end of the side wall, is frusto-conical as shown, tapering inwardly in an upstream direction. The downstream housing 34 is constructed and arranged for telescopic entry through the shell's open, downstream end, and has a downstream transverse wall 44 constructed with a frusto-conical shape 46 at its peripheral edge, and with a set of equally spaced flow grooves 46*a* formed therein. The wall 46 cooperates with the frusto-conical periphery 42 of the shell's side wall, so that the flow grooves provide the set of small spray apertures 14.

Extending upstream of transverse wall is an elongated sleeve 48 that surrounds a flow chamber 50 which communicates with the second set of flow apertures 16. The exterior of sleeve 48 is integral with bosses 40 for rigidification. The upstream end of sleeve 48 is shouldered at 51 to provide a seat thereon. Means are provided within the flow chamber 50 for providing pulsating character to the water flow that discharges through flow apertures 16. Such means includes a downstream propeller 52 and an upstream nozzle plate member 54 seated on shoulder 51.

The propeller 52 and nozzle plate 54 are generally of the type disclosed in co-pending application, Ser. No. 5,161 filed Jan. 22, 1979, but with some specific differences.

In the specific construction illustrated, the propeller 52 has a central shaft 56 that extends axially beyond the propeller's blades. The propeller 52 is an integral part molded of plastic, such as Delrin, and includes central shaft 56 from which project six (6) radially extending, equally cylindrically-spaced vanes 58, with an incomplete transverse web portion 60 located at the downstream end of propeller 52 and integral with downstream edges of some of vanes 58, to provide both a shutter 60 or flow-through spaces as shown. The lowermost side 52*a* of the web portion of propeller 52 must be flat and smooth.

The upstream side of transverse wall 44 is provided with a recess 44*a* for receiving thereinto the downstream shaft extension 56*a*. A thin, anti-friction, washer 62 of teflon is positioned between propeller 52 and the upstream side of transverse wall 44.

The nozzle plate 54 includes a transverse wall 64 that is shaped and arranged to provide jet-forming nozzles therein, which direct flow of water at an angled attitude, downwardly and tangentially, against the vanes 58 of the propeller 52, to cause the propeller to rotate. Passage of the web portion 60 across the upstream end of the flow apertures 16, during rotation of propeller 52, operates to interrupt flow through such apertures 16 and gives the effect of a pulsating jet being discharged from flow apertures 16.

The wall 64 of nozzle plate 54 is formed with six (6) upstream axial flow apertures 66 that communicate adjacent their downstream ends with laterally opening, discharge apertures 68 to provide the necessary turning of water flow to achieve the desired downwardly inclined and tangential effect angled against the vanes 58 of the propeller 52.

Extending downstream from the central portion of wall 64 is a sleeve 72 which is positioned to receive thereinto the upstream extension 56*b* of shaft 56. Extending upstream of wall 64 are a plurality of angle-shaped abutments 74 each having a horizontal leg 74*a* and a vertical leg 74*b* which operate to define a recess for receiving a centering sleeve that is provided on the downstream end of the diverter body hereinafter described. The nozzle plate 54 has an outwardly-extending flange 76 of a radial size adapted for seating on the shoulder 51, and a radially-inwardly located and upstream-extending flange 78 spaced from the upper end of sleeve 48 to provide a recess therebetween for receiving thereinto an O-ring seal 80 that is seated between flange 78 and the upper end portion of sleeve 48 with a portion of O-ring 80 extending upstream of flange 78, as seen in FIG. 3.

The space that surrounds sleeve 48 constitutes a chamber, or upstream flow passageway, 82 that communicates water flow therethrough to the first set of spray discharge apertures 14.

The body shell 12 is provided with an axially extending, elongated tubular inlet sleeve 84 that projects both upstream and downstream of the shell's dome 86. The upstream terminus of inlet sleeve 84 is male-threaded for cooperation with nut 26. The downstream terminus of inlet tube 84 provides a stop or abutment for a diverter body, generally indicated at 88. Body shell 12 is also provided with a radially disposed sleeve 90 whose radial axis projects to intersect a projection of the axis of inlet sleeve 84.

The diverter body 88 includes a downstream disc or plate 92 that is of a dimension to engage and seal against the uppermost portion of O-ring 80 to effect a continuous compression seal thereagainst. Spaced inwardly of the edge of disc 92 is a depending sleeve, or flange, 93 that is spaced concentrically inwardly of upstream extending flange 78 on nozzle plate 54 and outwardly of legs 74*b*. The resiliency of O-ring 80 accommodates a range of compression thereof as housing 34 telescopes into body shell 32 under the tension imposed by assembly bolts 36.

The diverter body 88 is shaped and arranged to provide thereon, upstream of disc 92, an elongated, radially-extending, control sleeve 94 open at both ends, an annular abutment disc 96, and an upstream extending entry-flow sleeve 98. The entry-flow sleeve 98 is of an external diameter less than the inner diameter of inlet tube 84 on the body shell 12. The entry-flow sleeve 98 is in flow communication with the interior of control sleeve 94 through water inlets 99 that extend through the upstream wall of said control sleeve 94. The downstream wall of control sleeve 94 is provided with water outlets 100. The water inlets 99 and outlets 100 in control sleeve 94 are radially offset from each other to cooperate with a flow diverter shaft as illustrated in FIGS. 3 and 4.

The radially disposed sleeve 90 through the side wall 32 of body shell 12 defines a cylindrical inner wall 102. The control handle 17 is shaped and arranged to have extending therefrom an elongated diverter shaft 104, a portion of which is constructed to enter the diverter control sleeve 94 to cooperate with the water inlets 99 and outlets 100 provided therein. The combined handle 17 and diverter shaft 104 is a molded body that provides thereon a radially-outermost recess 106 for receiving therein a first O-ring seal 108 of a size selected for rotary sealing engagement with the cylindrical wall 102 of sleeve 90. Spaced radially inwardly along the diverter shaft 104 is a reduced shaft portion 110, located inwardly of shell side wall 32, and onto which a snap-on retainer 112 may be pressfit. The retainer 112 is of a size to cause interference with and engage the inner side of wall 32, thereby preventing the diverter shaft 104 from being withdrawn from sleeve 90. The retainer 112 is provided with a stem 113 which permits of manual manipulation of the retainer 112 after diverter shaft 104 has been assembled with diverter body 88 and before downstream housing 34 has been telescoped and assembled into body shell 12. Spaced radially inwardly of reduced shaft portion 110, there is a second seal portion provided with a recess 114, in which is positioned a second O-ring seal 116. The seal 116 rotatably and sealingly engages the inner circular wall of control sleeve 94 at a region radially outwardly of outlet 100, so that water entering control sleeve 94 will not exit therefrom past seal 116. At the end of diverter shaft 104 distally of control handle 17, the diverter shaft 104 is provided with four (4) radially-extending ribs 118 which serve to center said distal end of diverter shaft 104 within the control sleeve 94. The spaces 120 between the ribs 116, as best seen in FIG. 5, provide a flow passageway that may receive water from inlets 99 for communicating inlet flow to chamber 82. Between said distal end of diverter shaft 104 and the portion of the diverter shaft that carries seal 116 there is provided on the diverter shaft a pair of spaced diagonal ribs 122 defining a diagonal groove, or recess, 124 within which is located a diverting O-ring seal 126 that when assembled as seen in FIGS. 3 and 4 takes the form of an elongated or ovate circle.

The ribs 122 and groove 124 are so arranged that when the handle 17 is in the position shown in FIG. 3, the O-ring seal 126 engages the inner wall of control sleeve 94 to cut off water flow from inlet 99 to outlet 100 and when the handle 17 is in the alternate selected position of FIG. 4, the water flow from inlet 99 is communicated only to outlet 100. Thus, in the flow position in FIG. 3 water from inlet 99 empties through the spaces 120 at the right-hand end of control sleeve 94 to be communicated to spray apertures 14; and in the flow position of FIG. 4 water from inlet 99 passes through sleeve 94 to outlet 100 for communication to the spray apertures 16.

In connection with the flow diverting action of O-ring seal 126, it will be seen that in the flow position of FIG. 3 the seal is between inlet 99 and outlet 100, and in the position of FIG. 4 the seal 126 is between the inlet 100 and the flow outlets 120 at the distal end of diverter shaft 104.

The entry-flow sleeve 98 on diverter body 88 is constructed to slidably enter the inlet tube 84 on shell body 12. To prevent seepage between the sleeves 98 and 84, an annular seal body 128 is positioned axially against the upstream terminus of entry-flow sleeve 98 and in engagement with the inner wall of inlet tube 84. The seal body 128 is adapted to have ball 24 of the ball connector 18 abut thereagainst, so that nut 26, in biasing pivot ball 24 against seal body 128, operates to force seal body 128 against both the inner wall of tube 84 and the terminus of entry-flow sleeve 98 to provide seals at both points and with the ball 24.

While a particular embodiment of this invention has been shown and described, it will be obvious to those skilled in the art that various changes and modifications may be made therein without departing from the spirit and scope of the invention and, therefore, it is intended in the appended claims to cover all such changes and modifications which fall within the true spirit and scope of the invention.

What is claimed is:

1. In a shower head having means for selectively discharging therefrom, alternatively, a shower spray from a first set of apertures or a pulsating shower spray from a second set of apertures, wherein the shower head includes an upstream axially elongated shell with a water inlet, a manually operable spray selector on the shell, a downstream housing as a part separate from the shell and from which water is discharged as said sprays, and diverter means between said shell and housing for selectively directing the discharging water either from the first or second set of apertures, the improvement comprising, in combination:

an axially-elongated diverter body, separate from said shell and downstream housing and positioned therebetween, said diverter body being shaped to provide an elongated, radially extending, control sleeve open at both ends, said diverter body also defining axially extending and radially offset intake and outlet flow passageways which intersect said control sleeve;

an elongated diverter shaft pivotably mounted in said control sleeve with a portion of said shaft adjacent one end thereof extending radially through said shell to said manually operable spray selector seal means carried on said diverter shaft adjacent said one end and providing a rotary seal both between said shaft and the diverter body and between the shaft and the shell to prevent water leakage therepast, the other end of said diverter shaft being constructed to permit water flow therepast, and diverting seal means carried on said diverter shaft for sealing engagement with the wall of the control sleeve, and being shaped to direct flow from the intake flow passageway in the diverter body either radially outwardly from the control sleeve or to the outlet flow passageway in the diverter body upon selective rotation of the diverter shaft; and said shell, diverter body, and downstream housing being shaped, constructed, and arranged to provide, alternatively, a first water flow path through the shower head communicating with said first set of apertures or a second flow path through the shower head communicating with said second set of apertures, depending on the position of the pivotable diverter shaft controlled by the spray selector.

2. A shower head as in claim 1 wherein said other end of said diverter shaft is shaped to provide spaced elements thereon adapted for cooperation with the control sleeve without interfering with water flow therepast.

3. A shower head as in claim 1 wherein said shell is shaped to provide an upstream tubular inlet including a connection portion extending upstream of the exterior of the shell, said elongated diverter body including an upstream extending, entry-flow sleeve constructed for telescopic entry within said tubular inlet on the shell, an annular upstream seal positioned in engagement with the upstream edge of said entry-flow sleeve of the diverter body and being surrounded by said sleeve on the shell, a ball member with flow passageway therethrough constructed for entry into the sleeve on the shell and for engaging said upstream seal, the outer surface of the sleeve on the shell being threaded, and a threaded annular nut cooperating with said threaded sleeve on the shell and with the ball member for forcing the ball member against said seal to compress same both against the intake sleeve on the diverter body and against the inner wall of the sleeve on the shell to provide a leak-proof connection with both sleeves.

4. A shower head as in claim 1 including a snap-on retainer removably mounted on the diverter shaft, at a point between the diverter body and shell, and being operatively associated with an adjacent portion of the shell for preventing disassembly movement of the diverter shaft radially outwardly of the shell.

5. A shower head as in claim 1 wherein the axially elongated shell has an open downstream end bounded by a side wall whose inner periphery, adjacent the downstream end of the sidewall, is frusto-conical and tapering inwardly in an upstream direction;

the downstream housing being adapted for telescopic entry upstream into the shell through the shell's open, downstream, end and having a downstream transverse wall constructed with a frusto-conical shape at the peripheral edge, and with a set of spaced spray-defining grooves thereon, for cooperation with said tapered side wall portion of the shell;

an elongated sleeve extending upstream, centrally from the upstream side of said downstream transverse wall, to define a flow chamber that communicates with said second set of apertures through which pulsating spray is to be discharged;

a propeller positioned downstream within said flow chamber and being rotatably mounted on said transverse wall, a nozzle plate seated on said sleeve at a position spaced above said propeller and constructed to receive axially flowing water and to discharge same tangentially toward said propeller to drive same, said nozzle plate cooperating with an adjacent portion of said sleeve to provide an upstream opening groove bounded laterally by portions of said sleeve and said nozzle plate;

a downstream O-ring seal located in and projecting upstream of said groove, and said O-ring being of a size adapted to be engaged along its circumferential length by the diverter body; and assembly means operatively associated with the shell and downstream housing for biasing said housing in a telescoping relation with the shell, and to cause the frusto-conical shape of the peripheral edge of the downstream transverse wall to abut the shell, while the downstream O-ring is distorted by engagement with the diverter body both to effect sealing relation with each of the elongated sleeve, the nozzle plate, and the diverter body, while also accommodating different axial spacings that, during assembly, occur between the upstream diverter body and the downstream nozzle plate carried on the elongated sleeve.

6. A shower head as in claim 3 wherein the shell has a side wall with a lateral opening therein, and the upstream tubular inlet on the shell extends downstream within the shell to provide an abutment that aids in positioning the control sleeve of the diverter body in substantial radial alignment with said lateral opening in the shell, to accommodate assembly of the shower head by inserting said other end of the diverter shaft through the shell's lateral opening for entry into the control sleeve of the diverter body.

7. A shower head as in claim 1 wherein said diverting seal means is an O-ring that is confined in a seal-receiving channel that is located in a plane that is inclined to the longitudinal axis of the diverter shaft and at such an angle as to cause the diverting seal means to bridge said intake flow passageway defined in the diverter body, and which intersects the control sleeve for all positions of pivoting of the diverter shaft in the control sleeve of the diverter body.

* * * * *